US007159609B2

(12) United States Patent
Chung

(10) Patent No.: US 7,159,609 B2
(45) Date of Patent: Jan. 9, 2007

(54) MOUNTING UNIT OF WALL FAUCET

(76) Inventor: Chiu-Chih Chung, No. 31, Lane 275, Sec. 4, Lu Ho Rd., Lu Kan Chen, Chunghua Hsien (TW)

( * ) Notice: Subject to any disclaimer, the term of this patent is extended or adjusted under 35 U.S.C. 154(b) by 0 days.

(21) Appl. No.: 11/143,613

(22) Filed: Jun. 3, 2005

(65) Prior Publication Data

US 2006/0272708 A1 Dec. 7, 2006

(51) Int. Cl.
*F16L 5/00* (2006.01)

(52) U.S. Cl. ..... 137/360; 137/801; 4/678

(58) Field of Classification Search ..... 137/360, 137/801; 4/678

See application file for complete search history.

(56) References Cited

U.S. PATENT DOCUMENTS 2,210,986 A * 8/1940 Martin ..... 251/217
2,747,604 A * 5/1956 Fraser ..... 137/360
3,392,746 A * 7/1968 Young ..... 137/360
4,662,389 A * 5/1987 Igbal ..... 137/359
5,697,393 A * 12/1997 Mirlisena, Sr. ..... 137/15.02

* cited by examiner

*Primary Examiner*—Eric Keasel
(74) *Attorney, Agent, or Firm*—Troxell Law Office, PLLC

(57) ABSTRACT

An improved mounting unit of wall faucet mainly is to design two locking ends extruded on the shutter near the granite counter to lock the locking units and position the water faucet on the granite counter; in addition, the locking ends are designed on the non-returning pads in the locking screw caps to prevent the water flow from effusion from the locking units. Therefore, because the locking units are locked directly on the locking ends of the water faucet and the water flow can directly flow from the locking screw caps of the locking units and inner thread portion vertically, so as to shorten the interval between the shutter and wall after the installation of water faucet into the shutter of a granite counter for saving space and costs in connection materials.

3 Claims, 4 Drawing Sheets

MOUNTING UNIT OF WALL FAUCET

BACKGROUND OF THE INVENTION

1) Field of the Invention

An improved mounting unit of wall faucet, in which two locking units are designed on the locking ends of the water faucet, and the water flow can directly flow from locking screw caps of the locking units and inner thread portion vertically, so as to shorten the interval between the shutter and wall after the installation of water faucet into the shutter of a granite counter for saving space and costs in connection materials.

2) Description of the Prior Art

The present invention mainly relates to an unit, after the completion of pipeline establishment, to connect the pipeline from the rear of the granite counter in the case of adding a water faucet on the counter, for the impossibility to make another pipeline; Generally, referring to the FIG. 1, the water faucet 5 is assembled through locking end of the shutter S of the granite counter and extrudes into the rear end of the shutter. In addition, because the part of the locking end 51 into the shutter is too long, it results in a big interval L1 of the shutter away the wall after the installation of feed pipe 6. Not only are the materials wasted, but also is the space occupied besides some deficiencies in use.

SUMMARY OF THE INVENTION

The improved mounting unit of wall faucet the present invention provides mainly is to design two locking ends extruded on the shutter near the granite counter to lock the locking units and position the water faucet on the granite counter; in addition, the locking ends are designed on the non-returning pads in the locking screw caps to prevent the water flow from effusion from the locking units. Therefore, because the locking units are locked directly on the locking ends of the water faucet and the water flow can directly flow from the locking screw caps of the locking units and inner thread portion vertically, so as to shorten the interval between the shutter and wall after the installation of water faucet into the shutter of a granite counter for saving space and costs in connection materials.

DETAILED DESCRIPTION OF THE PREFERRED EMBODIMENTS

Figure 1:
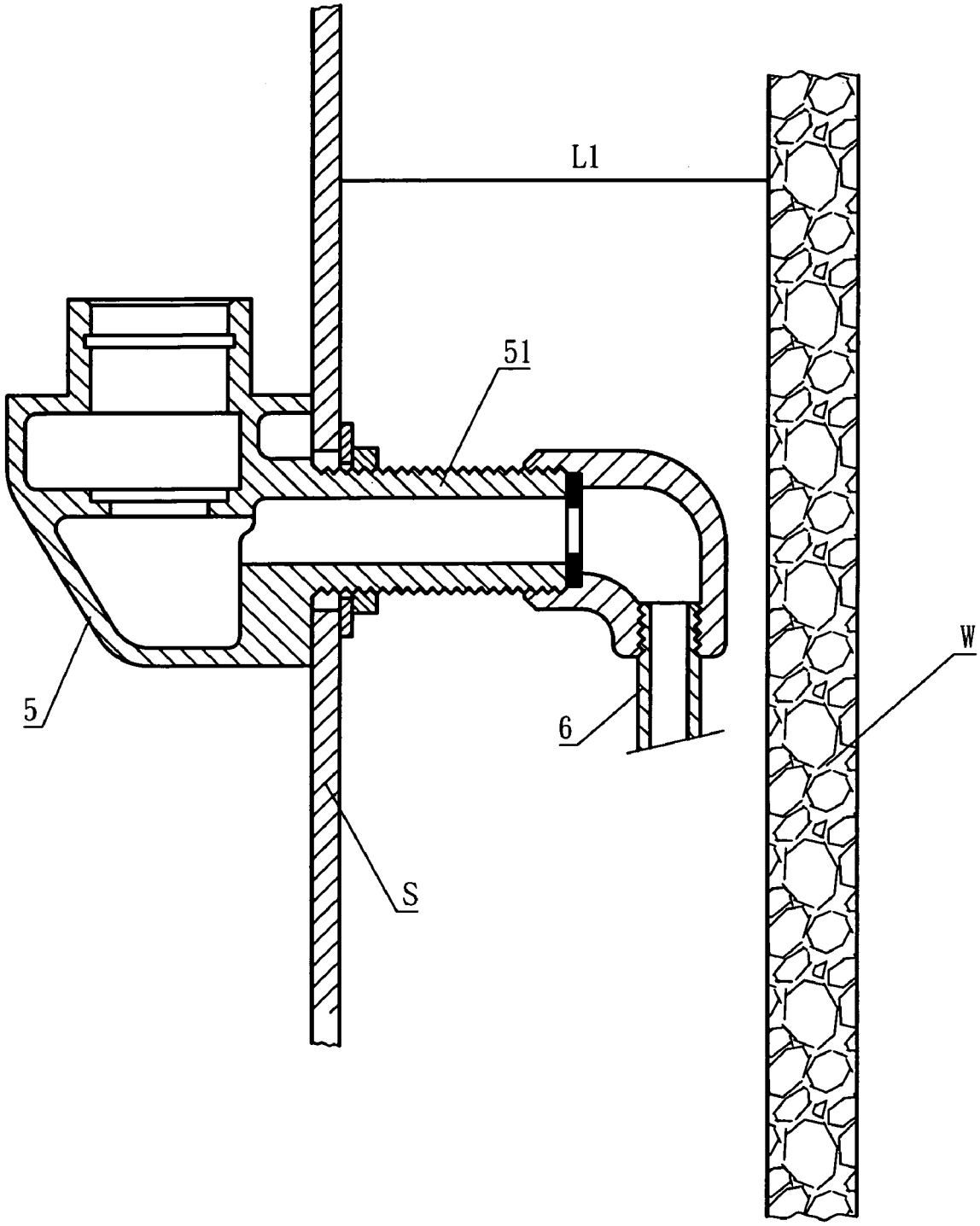
FIG. 1 PRIOR ART
FIG. 1 is the plane cutaway view of the prior art.
Figure 2:
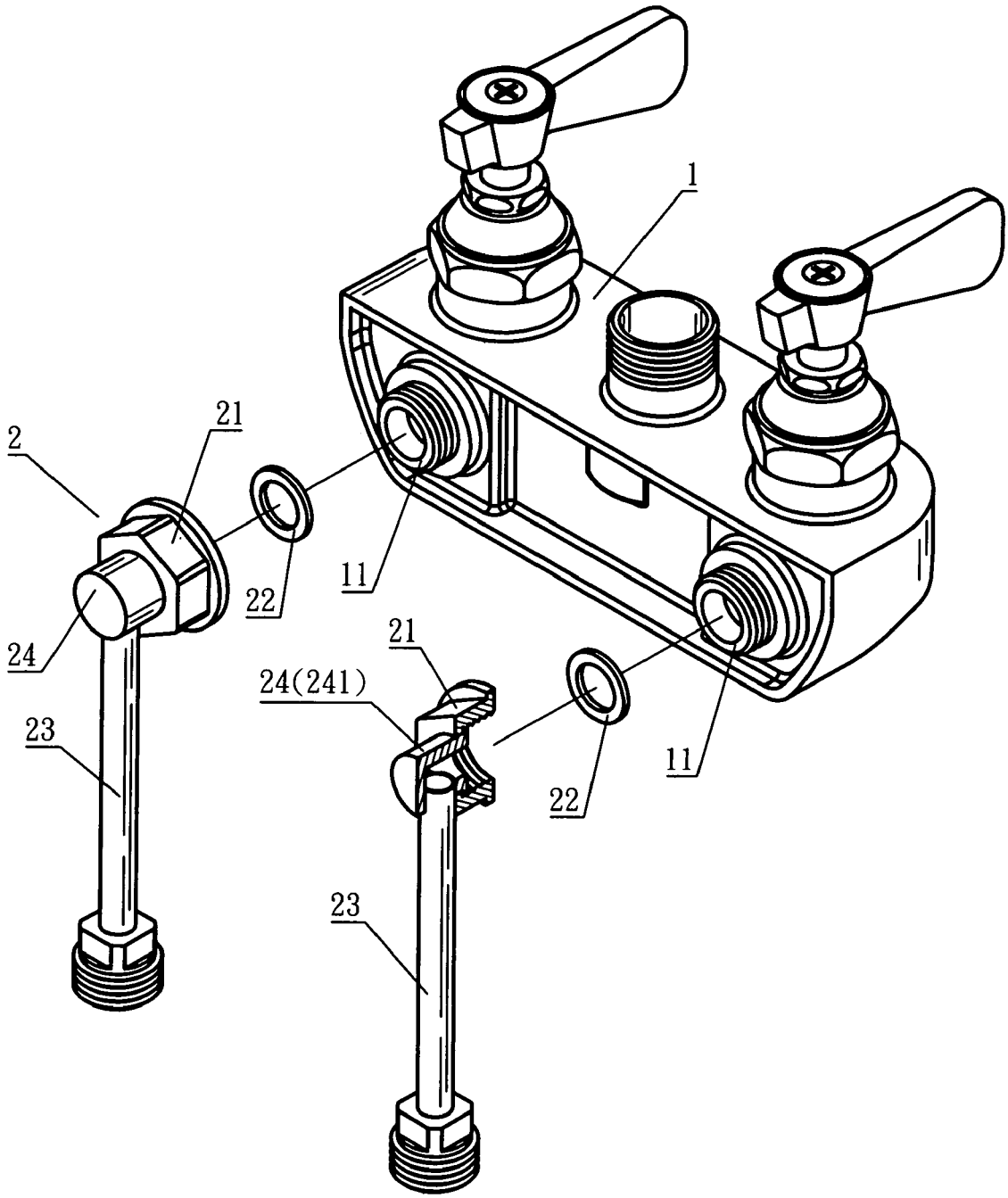
FIG. 2 is the three-dimensional exploded view of the present invention.
Figure 3:
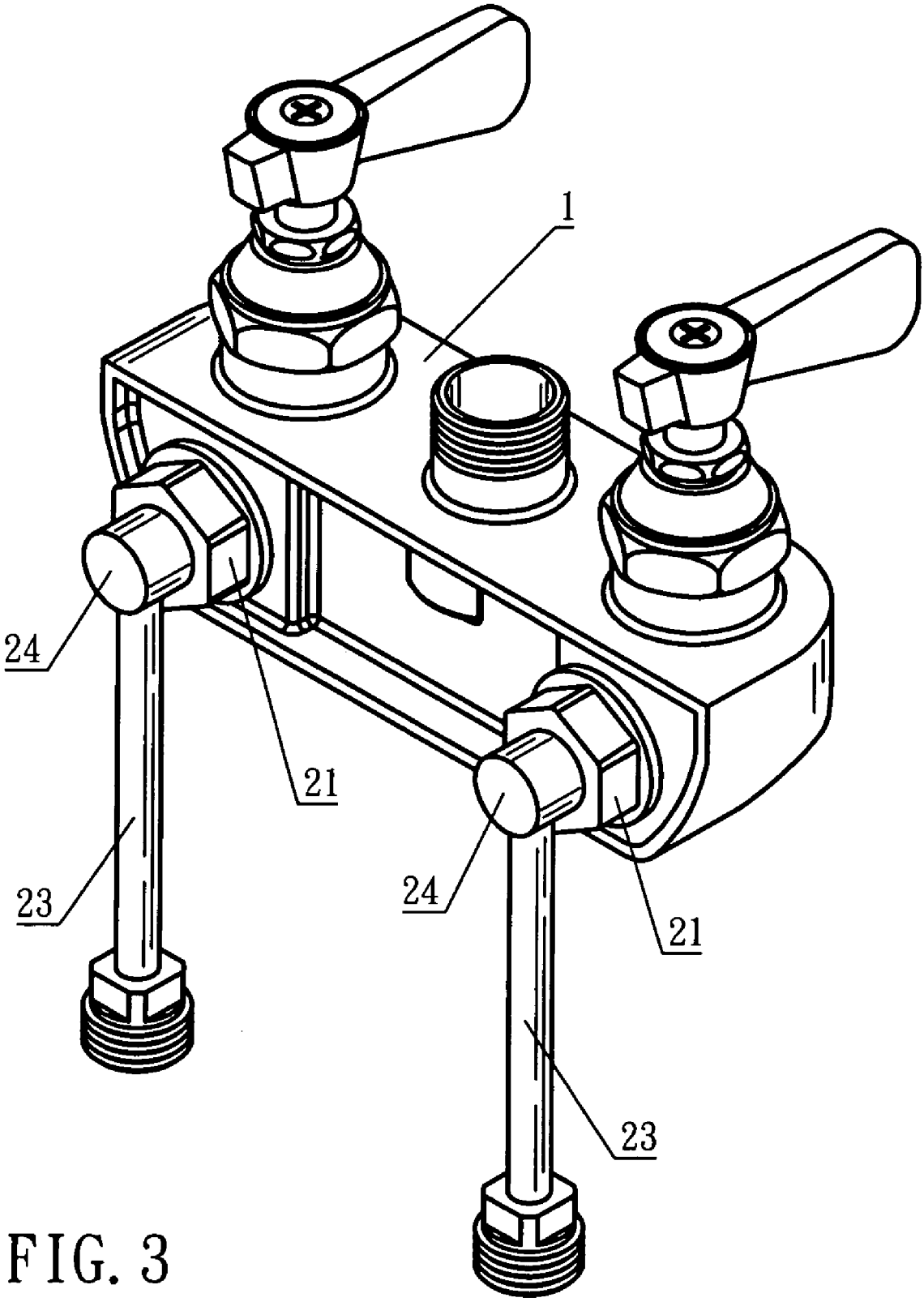
FIG. 3 is the three-dimensional combination diagram of the present invention.
Figure 4:
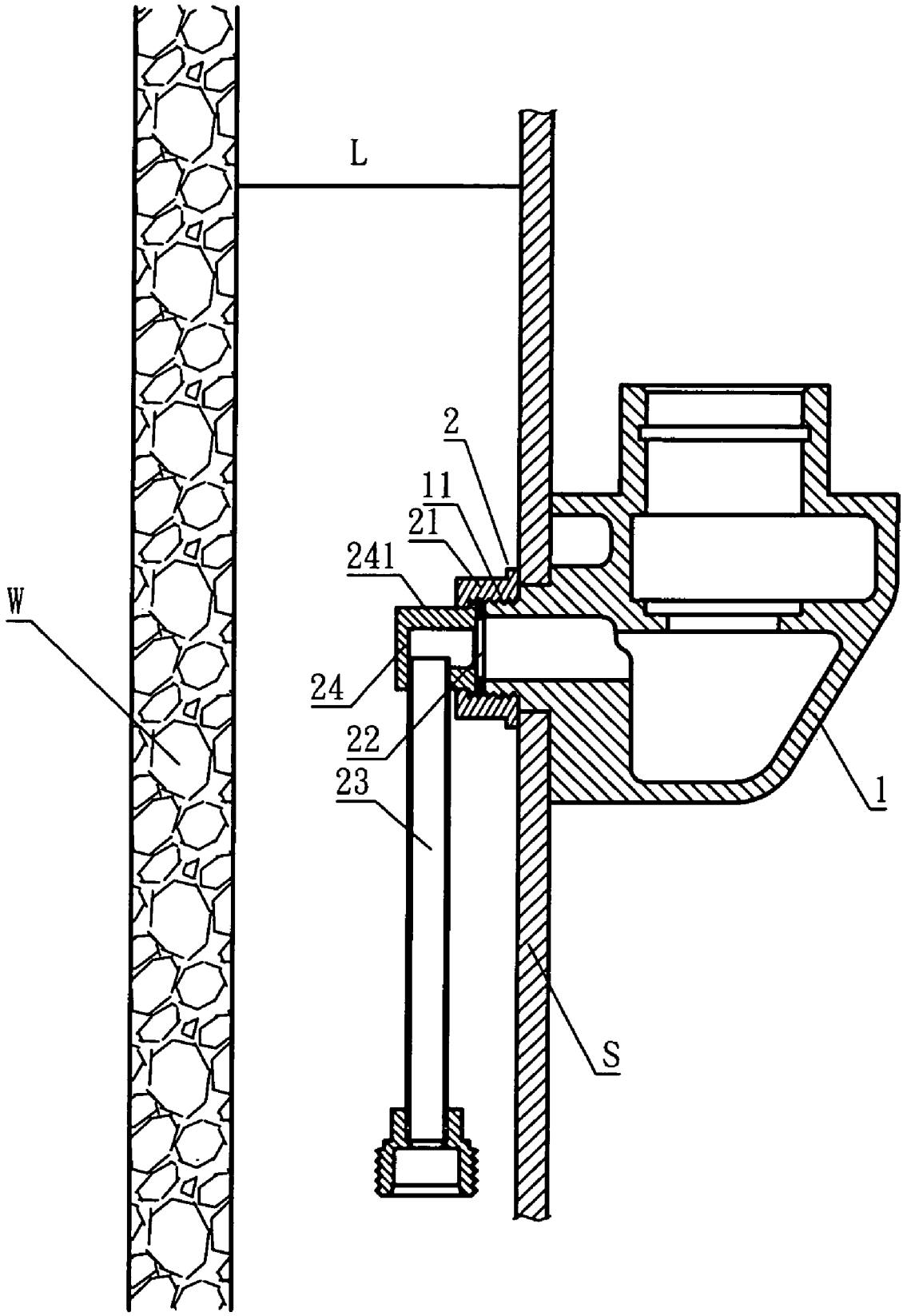
FIG. 4 is the plane cutaway view of the present invention.

Referring to the FIG. 2~FIG. 4, the unit of the present invention can be saw clearly, mainly is to design two locking ends 11 on the shutter S of the granite counter, which extrudes from the shutter S to lock the locking units 2 and position the water faucet 1 on the shutter S;

The locking unit 2 is composed of a locking screw cap 21 locked on the locking end 11 of the water faucet, a non-returning pad 22 in the locking screw cap 21 and a feed pipe 23 extruded from the end of the locking screw cap 21; in which:

The locking end 11 of the water faucet is designed on the non-returning pads 22 in the locking screw cap 21 after the locking screw cap 21 is locked on the locking end 11 of the water faucet 1 to prevent the water's effusion from the locking ends 11;

A ladder-shaped empty inner thread portion 24 is designed at the top end of the feed pipe 23, whose smaller ring-shaped surface end 241 goes through the locking screw cap 1 in advance, and then is interlinked with the feed pipe 23 connected to the inner thread portion 24 fixed on the base; additionally, the outer diameter of the inner thread portion 24 is less than the perforation diameter of the locking screw cap 21, so that the inner thread portion 24 can turn in the locking screw cap 21 to make the feed pipe 23 wiggly and aiming at the outlet pipeline properly after going through the locking screw cap 21;

Referring to FIG. 4, the water can directly flow through the locking screw cap 21 and inner thread portion 24 vertically after flowing through the locking end 11 of the water faucet 1. Therefore, because the locking units 2 are locked directly on the locking ends 11 of the water faucet 1 and the water flow can directly flow from the locking screw caps 21 of the locking units 2 and inner thread portion 24 vertically, so as to shorten the interval L between the shutter S and wall W after the installation of water faucet 1 into the shutter S of the granite counter for saving space and costs in consumptive materials.

What is claimed is:

1. A wall faucet assembly for a shutter of a granite counter top comprising:

a) a faucet having two locking ends extending through the shutter; and b) a locking unit having:

i) two locking screw caps, one of the two locking screw caps is threadedly connected to each of the two locking ends and wherein the locking screw caps abut the shutter;

ii) two non-return pads, one of the two non-return pads is located between one of the two locking screw caps and each of the two locking ends;

iii) two connector portions, each of the two connector portions has a ring portion located on an outer periphery of a first end thereof, one of the two connector portions is inserted through a hollow interior of each of the two locking screw caps and retained therein by the ring portion; and iv) two feed pipes, one of the two feed pipes extends outwardly from a second end of each of the two connector portions.

2. The wall faucet assembly according to claim 1, wherein the two locking ends of the faucet extend through the shutter.

3. The wall faucet assembly according to claim 1, wherein the shutter is located between the two locking ends and the two locking screw caps.

* * * * *